US009765579B2

(12) United States Patent
Greening et al.

(10) Patent No.: US 9,765,579 B2
(45) Date of Patent: Sep. 19, 2017

(54) TUBULAR STRESS MEASUREMENT SYSTEM AND METHOD

(71) Applicant: Tesco Corporation, Houston, TX (US)

(72) Inventors: Douglas Greening, Calgary (CA); Marinel Mihai, Calgary (CA); Brian Dewald, Calgary (CA); Piew Soe Saw, Calgary (CA)

(73) Assignee: TESCO CORPORATION, Houston, TX (US)

( * ) Notice: Subject to any disclaimer, the term of this patent is extended or adjusted under 35 U.S.C. 154(b) by 790 days.

(21) Appl. No.: 14/139,334

(22) Filed: Dec. 23, 2013

(65) Prior Publication Data

US 2015/0176370 A1 Jun. 25, 2015

(51) Int. Cl.

| | |
|---|---|
| ***G01D 1/16*** | (2006.01) |
| ***E21B 19/06*** | (2006.01) |
| ***E21B 47/00*** | (2012.01) |
| ***E21B 7/20*** | (2006.01) |

(52) U.S. Cl.
CPC ..... *E21B 19/06* (2013.01); *E21B 7/20* (2013.01); *E21B 47/0006* (2013.01)

(58) Field of Classification Search
CPC ..... G01N 3/08; E21B 41/00; E21B 19/06
USPC ..... 73/789
See application file for complete search history.

(56) References Cited

U.S. PATENT DOCUMENTS 5,238,273 A * 8/1993 Laflin ..... E21B 17/04 285/119
6,386,421 B1 * 5/2002 Anderson ..... B23K 37/0531 228/44.5
6,516,898 B1 * 2/2003 Krueger ..... E21B 4/18 175/230
7,156,182 B2 * 1/2007 Lynde ..... E21B 4/18 166/206
7,513,300 B2 * 4/2009 Pietras ..... E21B 19/00 166/380
7,665,531 B2 * 2/2010 Pietras ..... E21B 19/06 166/380
7,874,352 B2 * 1/2011 Odell, II ..... E21B 19/06 166/75.14
8,567,512 B2 * 10/2013 Odell, II ..... E21B 19/06 166/379
8,752,636 B2 * 6/2014 Liess ..... E21B 19/16 166/380
8,950,475 B2 * 2/2015 Angelle ..... E21B 19/07 166/77.1
2007/0074876 A1 4/2007 Pietras

FOREIGN PATENT DOCUMENTS

EP 2322755 5/2011

OTHER PUBLICATIONS

PCT International Search Report and Written Opinion dated Oct. 1, 2015.

* cited by examiner

*Primary Examiner* — Lisa Caputo
*Assistant Examiner* — Octavia Hollington
(74) *Attorney, Agent, or Firm* — Fletcher Yoder, P.C.

(57) ABSTRACT

Present embodiments are directed to a tubular stress measurement system including a first sensor configured to detect a parameter indicative of an axial or circumferential position of the plurality of grapples and a calculation system configured to calculate an internal stress on the tubular based on the parameter.

17 Claims, 4 Drawing Sheets

TUBULAR STRESS MEASUREMENT SYSTEM AND METHOD

BACKGROUND

Embodiments of the present disclosure relate generally to the field of drilling and processing of wells. More particularly, present embodiments relate to a system and method for measuring a tubular internal stress or force introduced by a tubular grappling system.

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is run into the well, the casing may be internally gripped by a grappling system of a top drive. Specifically, the grappling system may exert an internal pressure or force on the casing to prevent the casing from sliding off the grappling system. With the grappling system engaged with the casing, the weight of the casing is transferred to the top drive that hoists and supports the casing for positioning down hole in the well.

When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

BRIEF DESCRIPTION

In accordance with one aspect of the disclosure, a system includes a tubular grappling system having a mandrel, an actuator disposed about and coupled to the mandrel, and a plurality of grapples coupled to the actuator, wherein the actuator is configured to translate the plurality of grapples along angled surfaces of the mandrel, and the plurality of grapples is configured to engage with an inner diameter of a tubular. The system also includes a tubular stress measurement system having a first sensor configured to detect a parameter indicative of an axial or circumferential position of the plurality of grapples and a calculation system configured to calculate an internal stress on the tubular based on the parameter.

Another embodiment includes a method including detecting a first parameter indicative of an axial or circumferential position of a plurality of grapples configured to engage with an inner diameter of a tubular, calculating a radial travel distance of the plurality of grapples based on the parameter indicative of the axial or circumferential position of the plurality of grapples using one or more processors of a calculation system, and calculating an internal stress on the tubular based on the radial travel distance of the plurality of grapples using the one or more processors of the calculation system.

In accordance with another aspect of the disclosure, a system includes a data collection system having a magnet coupled to a plurality of grapples configured to engage with an inner diameter of a tubular, a magnetometer coupled to an actuator housing of an actuator, wherein the actuator is configured to axially actuate the plurality of grapples, wherein the magnetometer is axially aligned with the magnet, and a signal transmitter coupled to the actuator and configured to transmit a measurement detected by the magnetometer to a calculation system.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a tubular (e.g., casing) stress measurement system for a top drive system. Specifically, the tubular stress measurement system is configured to measure a stress or force acting on a string of tubular when a grappling system of the top drive system is engaged with the tubular. The grappling system includes grapples and a mandrel that are positioned within the tubular prior to hoisting. As described in detail below, the grapples are translated downward along angled surfaces of the mandrel to force the grapples radially outward such that the grapples engage with the internal diameter of the tubular. With the grapples engaged with the tubular, the grapples may apply a force or pressure on the tubular and thereby block the tubular from sliding off the grappling system when the tubular is hoisted and run into a well or hole by the top drive system. As the grapples are translated downward along the mandrel, the tubular stress measurement system measures an axial travel distance of the grapples. In the manner described in detail below, the measured axial travel distance of the grapples may be used to calculate a radial travel distance of the grapples. The radial travel distance of the grapples may then be used to calculate a stress (e.g. internal stress) on the tubular caused by the grapples.

Figure 1:
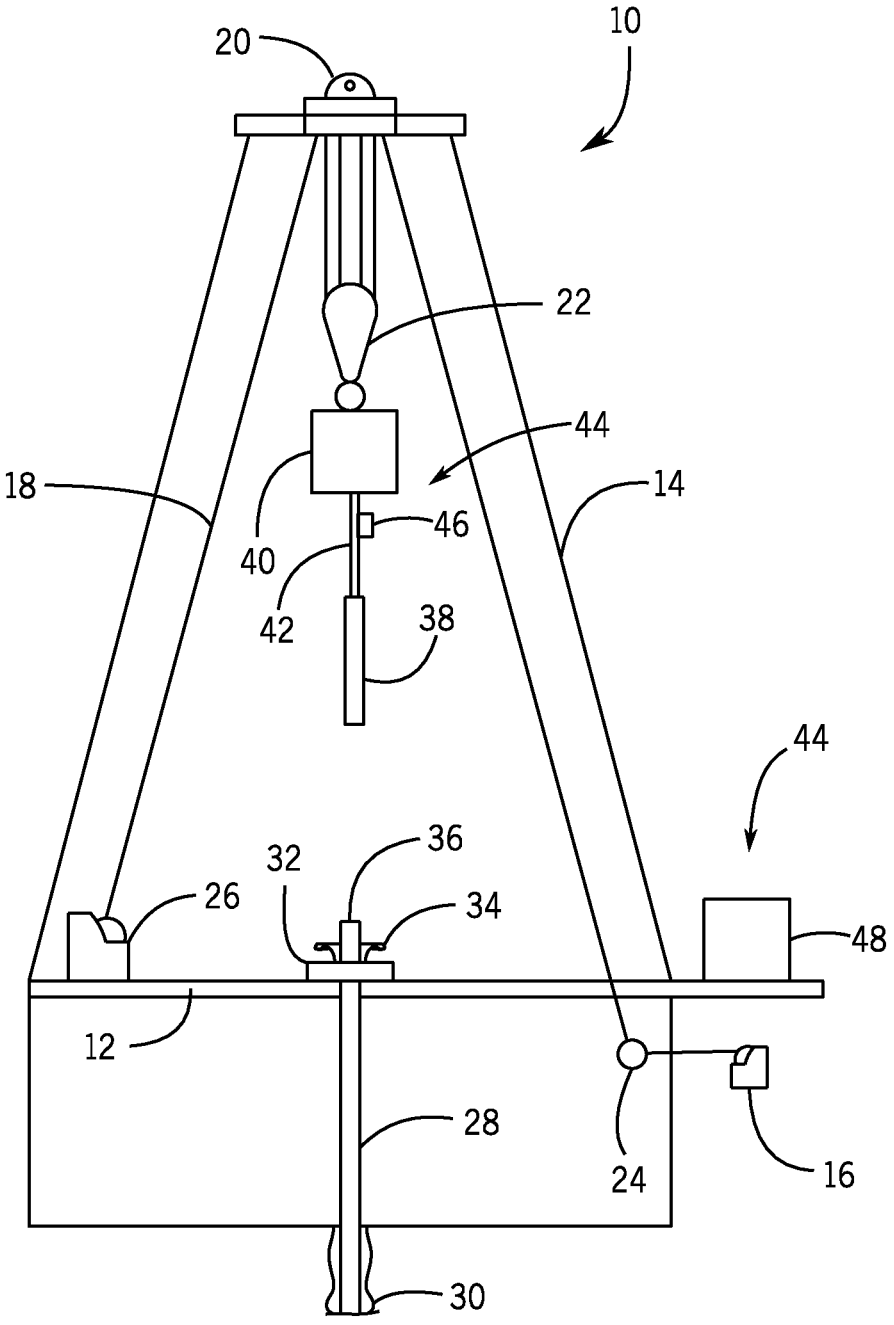
FIG. 1 is a schematic of a well being drilled, in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a casing string 28 extends downward into a wellbore 30 and is held stationary with respect to the rig floor 12 by a rotary table 32 and slips 34. A portion of the casing string 28 extends above the rig floor 12, forming a stump 36 to which another length of tubular 38 (e.g., casing) may be added. In certain embodiments, the tubular 38 may include 30 foot segments of oilfield pipe having a suitable diameter (e.g., 13⅜ inches) that are joined as the casing string 28 is lowered into the wellbore 30. As will be appreciated, in other embodiments, the length and/or diameter of segments of the casing 16 (e.g., tubular 38) may be other lengths and/or diameters. The casing string 28 is configured to isolate and/or protect the wellbore 30 from the surrounding subterranean environment. For example, the casing string 28 may isolate the interior of the wellbore 30 from fresh water, salt water, or other minerals surrounding the wellbore 30.

When a new length of tubular 38 is added to the casing string 28, a top drive 40, hoisted by the traveling block 22, positions the tubular 38 above the wellbore 30 before coupling with the casing string 28. The top drive 40 includes a grappling system 42 that couples the tubular 38 to the top drive 40. In operation, the grappling system 42 is inserted into the tubular 38 and then exerts a force on an internal diameter of the tubular 38 to block the tubular 38 from sliding off the grappling system 42 when the top drive 40 hoists and supports the tubular 38.

As described in detail below, the grappling system 42 further includes a tubular stress measurement system 44. The tubular stress measurement system 44 is configured to measure a stress (e.g., internal stress) in the tubular 38 caused by the force exerted on the tubular 38 by the grappling system 42. As shown, the tubular stress measurement system 44 includes a data collection system 46 and a calculation system 48. The data collection system 46 is coupled to the grappling system 42 and collects data for use in calculating the stress in the tubular 38. The data collected by the data collection system 46 is described in further detail below. The calculation system 48 of the tubular stress measurement system 44 receives (e.g., by wired or wireless transmission) the collected data from the data collection system 46 and calculates the stress in the tubular 38 using the collected data. In the illustrated embodiment, the calculation system 48 is separate from the data collection system 46. However, in other embodiments, both systems 46 and 48 may be combined and resident on the top drive 40.

It should be noted that the illustration of FIG. 1 is intentionally simplified to focus on the top drive 40 and grappling system 42 with the tubular stress measurement system 44 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
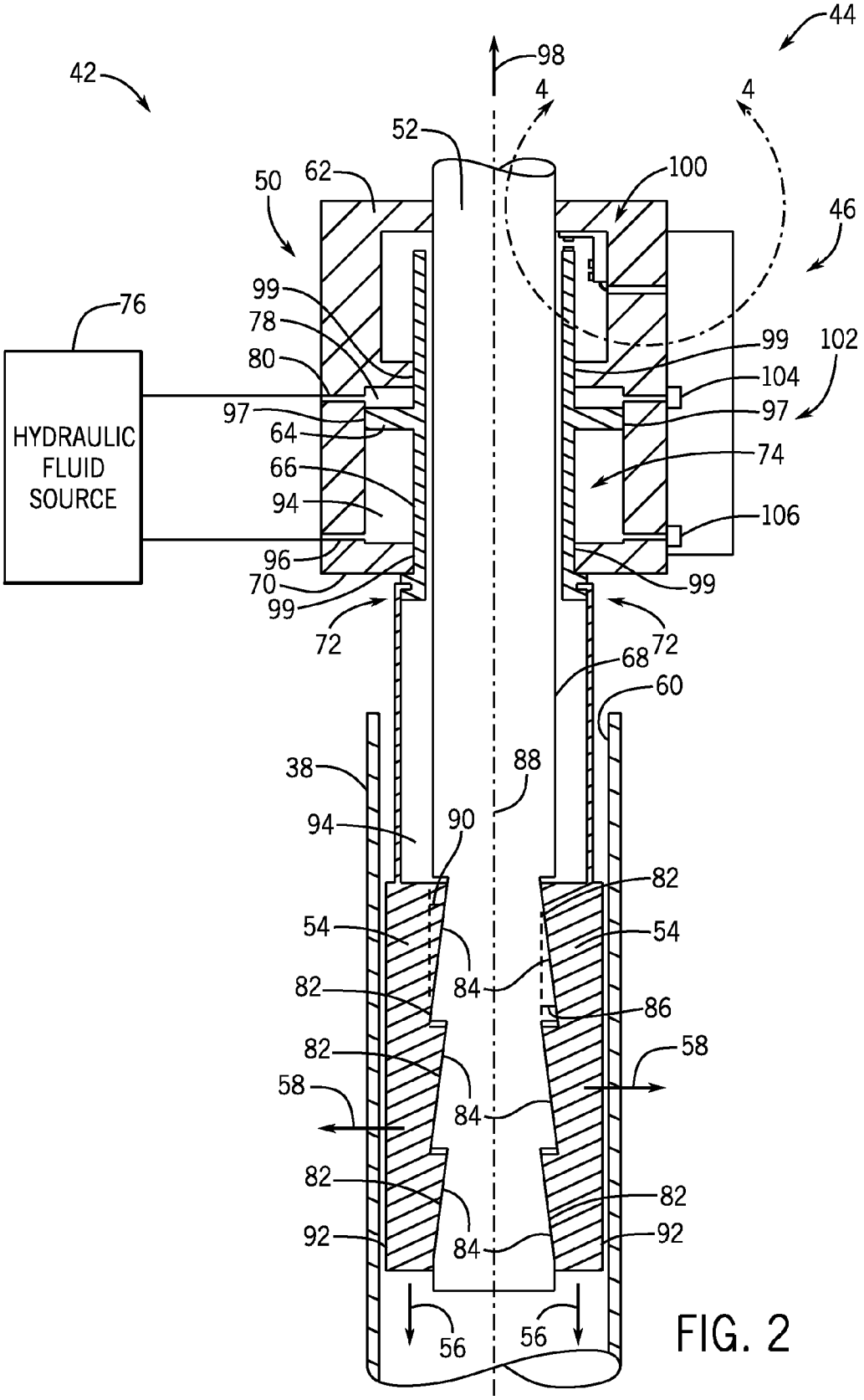
FIG. 2 is a cross-sectional schematic of a tubular grappling system and tubular stress measurement system, in accordance with present techniques.

FIG. 2 is a cross-sectional side view of the grappling system 42 and the tubular stress measurement system 44 of the top drive 40. In the illustrated embodiment, the grappling system 42 includes an actuator 50, a mandrel 52, and grapples 54 (e.g., dies, gripping surfaces, friction surfaces, etc.). To grip the tubular 38, the mandrel 52 and the grapples 54, which are disposed about the mandrel 52, are inserted or "stabbed" into the tubular 38. After the mandrel 52 and grapples 54 are disposed within the tubular 38, the grapples 54 may be translated downward, in a direction 56, by hydraulic actuation of the actuator 50. However, in other embodiments, the grapples 54 may be translated rotationally by mechanical actuation of the actuator 50. In the manner described below, the grapples 54 are forced radially outward, as indicated by arrows 58, and engaged with an inner diameter 60 of the tubular 38 when the grapples 54 are pushed downward by the actuator 50. Similarly, in embodiments where the actuator 50 rotates the grapples 54, the grapples 54 may similarly be forced radially outward to engage with the inner diameter 60 of the tubular 38.

In the illustrated embodiment, the actuator 50 is a hydraulic actuator. However, in other embodiments, the actuator 50 may be a mechanical actuator, electromechanical actuator, pneumatic actuator, or other type of actuator. The illustrated actuator 50 includes a hydraulic cylinder 62 coupled to the mandrel 52 and a piston 64 disposed within the hydraulic cylinder 62 and about the mandrel 52. The piston 64 is coupled to a piston sleeve 66 that extends around an outer diameter 68 of the mandrel 52. Additionally, the piston sleeve 66 extends out of the hydraulic cylinder 62 at a base 70 of the hydraulic cylinder 62 and couples to the grapples 54 disposed about the mandrel 52, as indicated by juncture 72.

To actuate the actuator 50 (e.g., the piston 64) in the illustrated embodiment, a hydraulic fluid (e.g., oil) is pumped into a piston chamber 74 of the actuator 50 from a hydraulic fluid source 76. For example, after the mandrel 52 and the grapples 54 are inserted into the tubular 38, hydraulic fluid may be pumped into the piston chamber 74 on a first side 78 of the piston 64 through a first port 80. As the hydraulic fluid is pumped into the piston chamber 74 on the first side 78 of the piston 64, pressure on the first side 78 builds, thereby forcing the piston 64 and the piston sleeve 66 downward (i.e., in the direction 56). As the grapples 54 are rigidly coupled to the piston sleeve 66 at the juncture 72, the grapples 54 also translate downward in the direction 56 when the hydraulic fluid is pumped into the piston chamber 74 on the first side 78 of the piston 64.

As mentioned above, when the grapples 54 are translated downward, the grapples 54 are forced radially outward by the mandrel 52, which remains stationary. Specifically, each of the grapples 54 includes one or more angled surfaces 82 that engage with one or more corresponding angled surfaces 84 of the mandrel 52. In the illustrated embodiment, each grapple 54 includes three angled surfaces 82. However, other embodiments of the grapples 54 may include a fewer or greater number of angled surfaces 82, where each angled surface 82 corresponds with one of the angled surfaces 84 of the mandrel 52. Each of the angled surfaces 84 of the mandrel 52 has a profile disposed at an outward angle 86 relative to a central axis 88 of the mandrel 52. In certain embodiments, the outward angle 86 may be approximately 1 to 10, 2 to 8, or 3 to 6 degrees. As will be appreciated by those skilled in the art, the magnitude of outward angle 86 (e.g., an angle of approximately 1 to 10, 2 to 8, or 3 to 6 degrees) may enable gradual radially outward movement of the grapples 54, thereby enabling improved control and/or operation of the grappling system 42. Furthermore, each angled surface 82 of the grapples 54 has a profile disposed at an inward angle 90 relative to the central axis 88 of the mandrel 52, where the inward angle 90 has a magnitude equal or similar to the outward angle 86 of the angled surfaces 84 of the mandrel 52. As the grapples 52 are forced downward by the actuator 50, the angled surfaces 82 of the grapples 54 will engage with the corresponding angled surfaces 84 of the mandrel 52 to force the grapples 54 radially outward (e.g., in the direction 58).

Each of the grapples 54 has a radially outward surface 92 that engages with the inner diameter 60 of the tubular 38 when the grapples 54 are forced radially outward by a sufficient amount using the actuator 50. When the radially outward surfaces 92 of the grapples 54 engage with the inner diameter 60 of the tubular 38, friction between the grapples 54 and the tubular 38 is increased, thereby blocking the tubular 38 from moving or slipping relative to the grapples 54 when the top drive 40 hoists and supports the tubular 38 during a well forming operation. In certain embodiments, the radially outward surfaces 92 may have coarse surfaces or may include surface treatments to increase friction between the grapples 54 and the inner diameter 60 of the tubular 38.

As mentioned above, the embodiments disclosed herein describe the actuator 50 having a hydraulic actuation mechanism. However, it will be appreciated that the actuator 50 may have other actuation mechanisms in other embodiments. For example, the actuator 50 may be mechanically actuated to rotate the grapples 54. In such an embodiment, the angled surfaces 82 of the grapples 54 and the angled surfaces 84 of the mandrel 52 may have horizontal orientations, as compared to the vertical orientations of the angled surfaces 82 and 84 shown in FIG. 2. In other words, the outward and inward angles 86 and 90 of the angled surfaces 82 and 84, respectively, may have a horizontal orientation. Additionally, in such an embodiment, the angled surfaces 82 and 84 may be curved to extend (e.g., partially extend) around a circumference of the mandrel 52. When the actuator 50 mechanical actuates (e.g., rotates) the grapples 54, the angled surfaces 82 of the grapples 54 will engage with the angled surfaces 84 of the mandrel 52 to radially expand the grapples 54 such that the grapples 54 engage with the inner diameter 60 of the tubular 38, as similarly described above.

After the tubular 38 is positioned above and coupled to the casing string 28, the grappling system 42 may release the tubular 38. Specifically, in the illustrated embodiment, hydraulic fluid may be pumped from the hydraulic fluid source 76 into the piston chamber 74 on a second side 94 of the piston 64 through a second port 96. The actuator 50 may include seals 97 disposed between the piston 64 and the cylinder 62 to block hydraulic fluid from flowing from the second side 94 to the first side 78. Similarly, the actuator 50 may include additional seals 99 disposed between the piston sleeve 66 and the cylinder 62 to block hydraulic fluid from exiting the piston chamber 74. As hydraulic fluid is pumped into the piston chamber 74 on the second side 94 of the piston 64, pressure may build on the second side 94 of the piston 64 to force the piston 64 upwards in a direction 98. As the piston 74 is forced upwards, the hydraulic fluid previously pumped into the piston chamber 74 on the first side 78 of the piston 64 (i.e., to engage the grapples 54 with the tubular 38) may exit the piston chamber 74 through the first port 80 and return to the hydraulic fluid source 76. As the piston 64 is actuated upwards, the piston sleeve 66 and the grapples 54 are also translated upwards (i.e., in the direction 98). As a result, the angled surfaces 82 of the grapples 54 may slide inwards and upwards along the angled surfaces 84 of the mandrel 52, and the radially outward surfaces 92 of the grapples 54 may disengage with the inner diameter 60 of the tubular 38. Thereafter, the grapples 54 and the mandrel 52 may be removed from the tubular 38, and the grappling process described above may be repeated to grab and hoist another length of tubular 38.

As will be appreciated, it may be desirable to monitor the stress (e.g., internal stress) on the tubular 38 that is caused by the grappling system 42 (e.g., the grapples 54). For example, if the force applied by the grapples 54 to the tubular 38 during the grappling process exceeds a threshold (e.g., a yield pressure of the tubular 38), the tubular 38 may deform and/or degrade. Accordingly, the top drive 40 and the grappling system 42 include the tubular stress measurement system 44 mentioned above. The tubular stress measurement system 44 includes the data collection system 46, which collects measurements associated with the operation of the grappling system 42. For example, the data collection system 46 includes a distance sensor system 100 and a pressure sensor system 102. The distance sensor system 100 may be configured to measure an axial travel distance of the piston sleeve 66 while the grapples 54 are engaged with the tubular 38. In other embodiments, such as embodiments where the actuator 50 mechanically rotates the grapples 54, the distance sensor system 100 may be configured to measure a rotational travel distance of the piston sleeve 66 and/or grapples 54. The axial or rotational travel distance of the piston sleeve 66 (or grapples 54) measured by the distance sensor system 100 may then be used to calculate an internal stress of the tubular 38. The components of the distance sensor system 100 are described in further detail below with reference to FIG. 4.

The pressure sensor system 102 includes two pressure sensors (e.g., a first pressure sensor 104 and a second pressure sensor 106) to measure pressures inside the piston chamber 74. Specifically, the first pressure sensor 104 is exposed to the piston chamber 74 on the first side 78 of the piston 64. Similarly, the second pressure sensor 106 is exposed to the piston chamber 74 on the second side 94 of the piston 64. The pressure measurements collected by the first and second pressure sensors 104 and 106 may be used to help determine when the grapples 54 are engaged with the inner diameter of the tubular 38. For example, in the illustrated embodiment, the grapples 54 are not yet engaged with the inner diameter 60 of the tubular 38. Accordingly, during initial actuation of the actuator 50 (e.g., when hydraulic fluid is first pumped into the piston chamber 74 on the first side 78 of the piston 64), the pressure of the piston chamber 74 measured by the first pressure sensor 104 may be relatively low. After the hydraulic fluid forces the piston 64 downward to the point where the grapples 54 are engaged with the inner diameter 60 of the tubular 38, the pressure measured by the first pressure sensor 104 will increase more sharply as the tubular 38 provides resistance.

Figure 3:
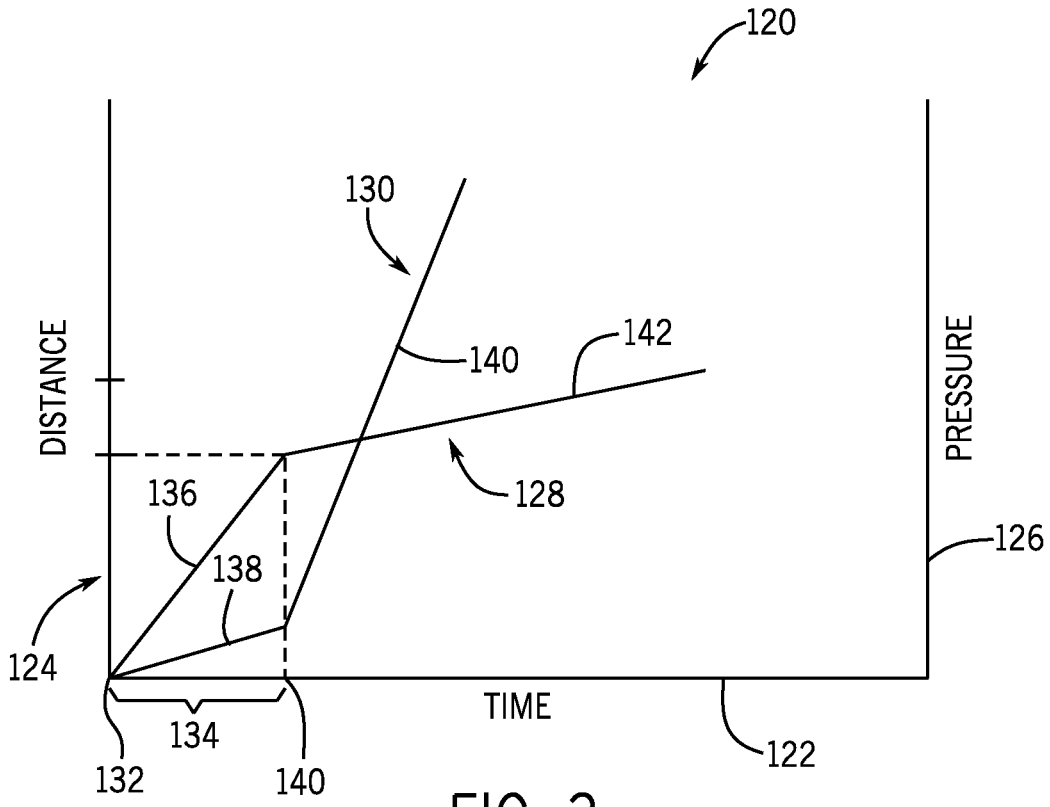
FIG. 3 is a graph illustrating pressure measurements of an actuator of the tubular grappling system and a radial travel distance of grapples of the tubular grappling system with respect to time, in accordance with present techniques.

FIG. 3 is a graph 120 that illustrates the measurements of the first pressure sensor 104 and the radial travel distance of the grapples 54 when the grappling system 42 is actuated by the actuator 50. Specifically, the graph 120 includes an X-axis 122 representing time, a first Y-axis 124 representing the radial travel distance of the grapples 54, and a second Y-axis 126 representing pressure measured by the first pressure sensor 104. A first line 128 represents the radial travel distance of the grapples 54 during actuation of the grappling system 42 as a function of time. A second line 130 represents the pressure measured by the first pressure sensor 104 during actuation of the grappling system 42 as a function of time.

As mentioned above, after the mandrel 52 and grapples 54 are initially inserted into the tubular 38, the grapples 54 may not be in contact with the inner diameter 60 of the tubular 38. As a result, when the actuator 50 is first actuated by pumping hydraulic fluid into the piston chamber 74 on the first side 78 of the piston 64, the pressure measured by the first pressure sensor 104 may be relatively low. For example, at a time 132, hydraulic fluid may begin pumping into the piston chamber 74 on the first side 78 of the piston 64. During a first time period 134 when the hydraulic fluid is pumping into the piston chamber 74, the piston 64 and the piston sleeve 66 may translate downwards, and the grapples 54 may begin moving radially outwards toward the inner diameter 60 of the tubular 38, as indicated by segment 136 of the first line 128. During the first time period 134, the pressure measured by the first pressure sensor 104 is relatively low and increases marginally, as indicated by segment 138 of the second line 130, because the piston 64 moves with little resistance as the grapples 54 have not yet contacted the inner diameter 60 of the tubular 38.

At a time 140, the grapples 54 contact the inner diameter 60 of the tubular 38. When the grapples 54 contact the inner diameter 60 of the tubular 38, movement of the grapples 54, and therefore the piston 64, is resisted by the tubular 38. Accordingly, the pressure inside the piston chamber 74 on the first side 78 of the piston 64 will increase more rapidly, as indicated by segment 140 of the second line 130. Additionally, as radially outward movement of the grapples 54 is resisted by the tubular 38 when the grapples 54 contact the tubular 38, the travel distance of the grapples 54 will increase more slowly, as indicated by segment 142 of the first line 128. Indeed, the radially outward travel distance of the grapples 54 when the grapples 54 are in contact with the inner diameter 60 of the tubular 38 may equal or approximately equal a radially outward travel distance (e.g., expansion) of the tubular 38. Accordingly, as described in detail below, the data collection system 46 of the tubular stress measurement system 44 is configured to measure the axial travel distance of the piston sleeve 66, which may then be used to calculate the radially outward travel distance of the grapples 54 after the grapples 54 have contacted the inner diameter 60 of the tubular 38. As will be appreciated, once the radially outward travel distance (e.g., expansion) of the tubular 38 is determined, a stress (e.g., internal stress) on the tubular 38 may be calculated.

Figure 4:
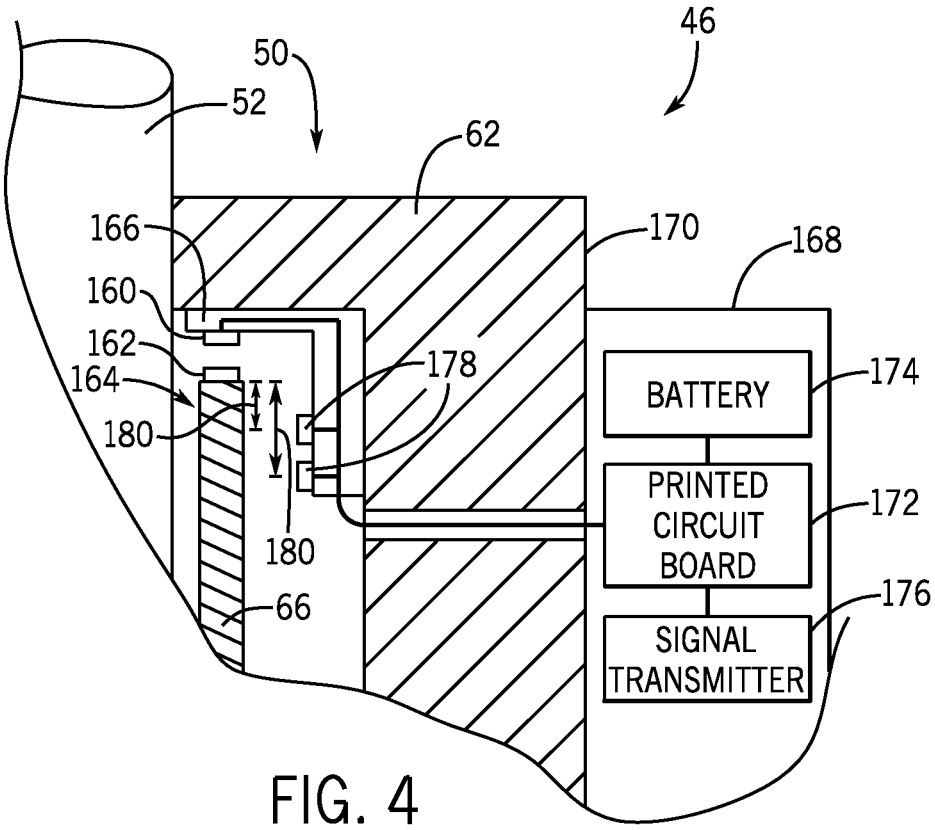
FIG. 4 is schematic of a data collection system of the tubular stress measurement system, in accordance with present techniques.

FIG. 4 is a schematic representation of the data collection system 46 of the tubular stress measurement system 44. As mentioned above, the data collection system 46 may be configured to measure an axial travel distance (or a rotational travel distance) of the piston sleeve 66 during actuation of the actuator 50 with the distance sensor system 100. To this end, the data collection system 46 or distance sensor system 100 includes a variety of sensors that enable measurement of the axial travel distance of the piston sleeve 66. For example, in the illustrated embodiment, the data collection system 46 includes a magnetometer 160 (e.g., Hall effect sensor) disposed above a magnet 162 (e.g., a cylindrical or rectangular rare earth magnet) that is positioned on an axial end 164 of the piston sleeve 66. As will be appreciated by those skilled in the art, the magnetometer 160 (e.g., Hall effect sensor) may be configured to precisely and accurately measure a magnetic field strength of the magnet 162. The magnetometer 160 and the magnet 162 may also be resistant to extreme temperatures, debris, or other environmental conditions to which the data collection system 46 may be exposed. However, in other embodiments, the distance sensor system and/or data collection system 46 may include other sensors and components, such as lasers, optical sensors, ultrasonic sensors, acoustic sensors, radio-frequency identification (RFID) chips or tags, etc. For example, in such embodiments, an emitter (e.g., laser, ultrasonic device, etc.) may be positioned in the location of the magnetometer 160, and the emitter may emit a wave (e.g., light wave or sound wave) that reflects off of the axial end 164 of the piston sleeve 66. The wave reflecting off of the piston sleeve 66 may then be detected by a detector, which may be integrated with the emitter or positioned next to the emitter (e.g., at or near the position of the magnetometer 160).

In the illustrated embodiment, the magnetometer 160 is mounted to a sensor mount 166 (e.g., an aluminum bracket) coupled to the cylinder 62 of the actuator 50. The magnetometer 160 is a transducer that varies its output voltage in response to a magnetic field measurement, and the magnet 162 is a permanent magnet that emits a strong magnetic field. For example, the magnet 162 may be a neodymium magnet or a samarium-cobalt magnet. The centers of the magnetometer 160 and the magnet 162 are axially aligned or positioned relative to one another to enable the magnetometer 160 to reliably measure the magnetic field strength of the magnet 162. For example, the magnetometer 160 may measure the magnetic field strength of the magnet 162 at a frequency of approximately 100 Hertz.

When the piston sleeve 66 (and thus the grapples 54) move axially, the magnetic field of the magnet 162 measured by the magnetometer 160 will change, as the magnetometer 160 remains fixed to the cylinder 62 of the actuator 50, while the magnet 162 moves with the piston sleeve 66. For example, when the piston sleeve 66 and the grapples 54 move downward during actuation of the actuator 50, the magnetic field of the magnet 162 measured by the magnetometer 160 may decrease as the magnet 162 moves away from the magnetometer 160. Conversely, when the piston sleeve 66 and the grapples 54 move upward during release of the grapples 54 from the tubular 38, the magnetic field of the magnet 162 measured by the magnetometer 160 may increase as the magnet 162 moves closer to the magnetometer 160. As mentioned above, the magnetometer 160 outputs a voltage indicative of the measured magnetic field strength of the magnet 162. Thus, a change in the voltage output of the magnetometer 160 is indicative of a change in axial position of the magnet 162.

In embodiments where the actuator 50 mechanically rotates the grapples 54, the magnet 162 may be disposed on a side (e.g., outer circumference) of the piston sleeve 66 and the magnetometer 160 may be radially offset from the piston sleeve 66 and mounted to the sensor mount 166. In such an embodiment, the magnetometer 160 may similarly measure a change in the measured magnetic field of the magnet 162 as the grapples 54, the piston sleeve 66, and the magnet 162 rotate. For example, as similarly described above, when the grapples 54, piston sleeve 66, and magnet 162 rotate, the magnet 162 may rotate away from the magnetometer 160, and the voltage output of the magnetometer 160 may decrease. Conversely, when the grapples 54, piston sleeve 66, and magnet 162, the magnet 162 may rotate toward from the magnetometer 160, and the voltage output of the magnetometer 160 may increase. As similarly described above, a change in the measured magnetic field of the magnet 162 is indicative of a change in rotational position of the magnet 162, and thus the grapples 54.

The data measurements obtained by the magnetometer 160 may be transmitted to the calculation system 48 of the tubular stress measurement system 44. In the illustrated embodiment, the magnetometer 160 is coupled to electrical components disposed inside a junction box 168 that is mounted to an exterior 170 of the cylinder 62 of the actuator 50. The electrical components include a printed circuit board 172, a battery 174, and a signal transmitter 176. The printed circuit board 172 receives the measured data from the magnetometer 160, and the signal transmitter 176 transmits the measured data to the calculation system 48 of the tubular stress measurement system 44. For example, the signal transmitter 176 may include an antenna that transmits the data as a radio signal to a signal receiver of the calculation system 48. The signal transmitter 176 may also transmit measurements obtained by the first and second pressure sensors 104 and 106 to the calculation system 48. In other embodiments, the data collection system 46 and the calculation system 48 may be hard wired to one another. For example, the data collection system 46 and the calculation system 48 may be integrated or combined with one another and may both be positioned on the top drive 40.

The data collection system 46 further includes additional magnetometers (e.g., magnetic latching switches) 178 coupled to the sensor mount 166. More particularly, the additional magnetometers 178 are positioned approximately 90 degrees from the magnetometer 160. Accordingly, the additional magnetometers 178 are positioned on a lateral side of the magnet 162. In certain embodiments, the additional magnetometers 178 may be positioned a distance of approximately one-third the total stroke of the piston sleeve 66 from the magnetometer 160 (e.g., approximately 1 to 2 inches). In other words, the additional magnetometers 178 may be positioned one above the other, where the average distance of the additional magnetometers 178 is approximately one-third the total stroke of the piston sleeve 66 from the magnetometer 160.

The additional magnetometers 178 enable calibration of the magnetometer 160. While the illustrated embodiment includes two additional magnetometers 178 for redundancy, other embodiments may include fewer or more additional magnetometers 178, including no additional magnetometers 178. In FIG. 4, the piston sleeve 66 is shown in a baseline or "zeroed out" position when the actuator 50 is not actuated. In this baseline position, axial distances 180 between the magnet 162 and each of the additional magnetometers 178 may be known. When the piston sleeve 66 moves downward during actuation of the actuator 50, the magnet 162 may pass the one or both of the additional magnetometers 178. As each of the additional magnetometers 178 have an orientation perpendicular to the orientation of the magnet 162, the magnetic field of the magnet 162 measured by the additional magnetometers 178 will switch (e.g., from north to south) when the magnet 162 passes each of the additional magnetometers 178. Thus, when the measured magnetic field switches for one of the additional magnetometers 178, an operator or user will know the precise axial position of the magnet 162 and the piston sleeve 66 at that time. Therefore, each stroke of the piston 64 may be used to calibrate the measurements of the magnetometer 160.

Figure 5:
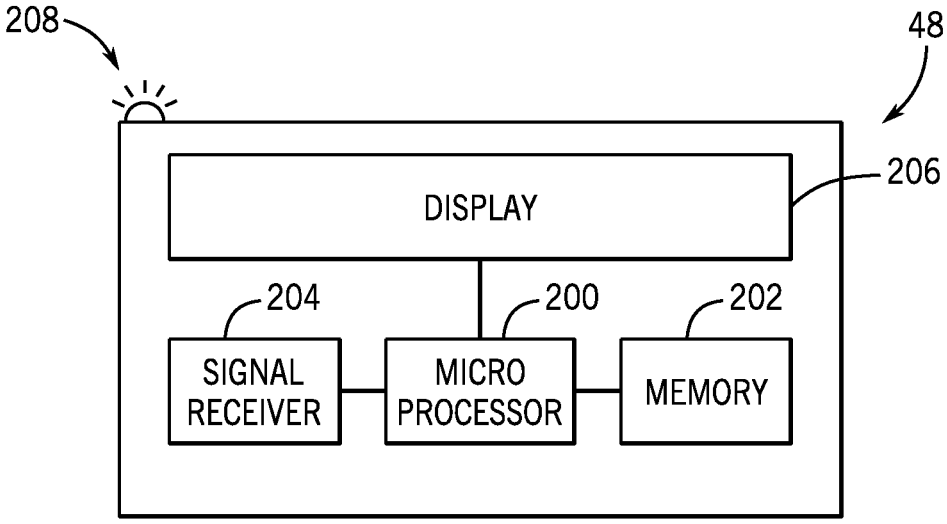
FIG. 5 is a schematic of a calculation system of the tubular stress measurement system, in accordance with present techniques.

FIG. 5 is a schematic representation of the calculation system 48 of the tubular stress measurement system 44. The calculation system 48 includes one or more microprocessors 200, a memory 202, a signal receiver 204, and a display 206. The memory 202 is a non-transitory (not merely a signal), computer-readable media, which may include executable instructions that may be executed by the microprocessor 200. Additionally, the memory 202 may be configured to store data collected by the calculation system 48. For example, the signal receiver 204 may receive data measurements from the data collection system 46. These data measurements may include voltage output data from the magnetometer 160 and/or additional magnetometers 178, pressure measurements from the first and second pressure sensors 104 and 106, or other data. Using the collected data, the microprocessor 200 may calculate an axial position (or rotational position) of the magnet 162, the piston sleeve 66, and the grapples 54. In certain embodiments, one or more of the components described above (e.g., microprocessors 200, memory 202, signal receiver 204, and/or display 206) may be additionally and/or alternatively located within the junction box 168 coupled to the actuator 50. Similarly, the components of the junction box 168 may additionally and/or alternatively be included with the calculation system 48.

Based on the measured axial (or rotational) position of the magnet 162, the radially outward travel distance of the grapples 54 can be calculated. Specifically, as described above, when the piston sleeve 66 and the grapples 54 are actuated axially downward (or rotationally around), the angled surfaces 84 of the mandrel 52 force the grapples 54 radially outward toward the inner diameter 60 of the tubular 38. As the angle 86 of the angled surfaces 84 of the mandrel 52 is known, the radial travel distance of the grapples 54 can be calculated based on the axial travel distance (or rotational travel distance) of the piston sleeve 66 and grapples 54 measured by the magnetometer 160. In particular, the radial travel distance of the grapples 54 once the grapples 54 have contacted the inner diameter 60 of the tubular 38 (i.e., once the pressure measured by the first pressure sensor 104 begins to increase rapidly) may be calculated. Thereafter, the internal stress of the tubular 38 may be calculated based on the radial travel distance of the grapples 54 after the grapples 54 have contacted the inner diameter 60 of the tubular 38. In certain embodiments, a threshold internal stress valve may be stored in the memory 202. If the calculated internal stress meets or exceeds the threshold internal stress value, an alarm 208, such as an auditory and/or visual alarm, of the tubular stress measurement system 44 may be activated to alert a user or operator that the calculated internal stress of the tubular 38 has exceeded the threshold.

As discussed in detail above, the present embodiments provide the tubular stress measurement system 44. Specifically, the tubular stress measurement system 44 is configured to measure a stress or force acting on a length of tubular 38 when the grappling system 42 of the top drive 40 is engaged with the tubular 38. The grappling system 42 includes the grapples 54 and mandrel 52 that are positioned within the tubular 38 prior to hoisting. Within the tubular 38, the grapples 54 are translated downward or rotationally (e.g., by actuator 50) along angled surfaces 84 of the mandrel 52 to force the grapples 54 radially outward such that the grapples 54 engage with the internal diameter 60 of the tubular 38. With the grapples 54 engaged with the tubular 38, the grapples 54 may apply a force or pressure on the tubular 38 and thereby block the tubular 38 from sliding off the grappling system 42 when the tubular 38 is hoisted and run into the wellbore 30 by the top drive 40. As the grapples 54 are translated downward or rotationally along the mandrel 52, the tubular stress measurement system 44 measures an axial or rotational travel distance of the grapples 54. Specifically, the tubular stress measurement system 44 includes magnetometers 160 and 178 that measure the magnetic field strength of the magnet 162 coupled to the piston sleeve 66 actuating the grapples 54. The measured magnetic field strength is then used to calculate the axial or rotational travel distance of the grapples 54. Thereafter, the axial or rotational travel distance of the grapples 54 may be used to calculate a radial travel distance of the grapples 54. More specifically, the radial travel distance of the grapples 54 after the grapples 54 have contacted the inner diameter 60 of the tubular 38 is calculated using the method described above. Once the radial travel distance of the grapples 54 is determined, a stress (e.g. internal stress) in the tubular 38 caused by the grapples 54 may be calculated.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:
a tubular grappling system, comprising:
a mandrel;
an actuator disposed about and coupled to the mandrel; and
a plurality of grapples coupled to the actuator, wherein the actuator is configured to translate the plurality of grapples along angled surfaces of the mandrel, and the plurality of grapples is configured to engage with an inner diameter of a tubular; and
a tubular stress measurement system, comprising:
a first sensor configured to detect a parameter indicative of an axial or circumferential position of the plurality of grapples; and
a calculation system configured to calculate an internal stress on the tubular based on the parameter,
wherein the tubular stress measurement system comprises a magnet coupled to the actuator, wherein the first sensor comprises a magnetometer configured to detect a magnetic field strength of the magnet, wherein the magnet is disposed on an axial end of a piston sleeve of the actuator, and wherein the piston sleeve is coupled to the plurality of grapples.

2. The system of claim 1, wherein the magnet is a cylindrical or rectangular rare earth magnet.

3. The system of claim 1, wherein the tubular stress measurement system comprises a junction box coupled to the actuator, wherein the junction box comprises a printed circuit board coupled to the first sensor and a signal transmitter configured to send data from the junction box to the calculation system.

4. The system of claim 1, wherein the calculation system comprises one or more non-transitory, computer-readable media having executable instructions stored thereon, the executable instructions comprising:
instructions adapted to calculate a radial travel distance of the plurality of grapples based on the parameter indicative of the axial or circumferential position of the plurality of grapples.

5. The system of claim 4, wherein the radial travel distance of the plurality of grapples is a radial travel distance of the plurality of grapples after the plurality of grapples have contacted an inner diameter of the tubular.

6. The system of claim 4, wherein the executable instructions comprise instructions adapted to calculate an internal stress on the tubular based on the radial travel distance of the plurality of grapples.

7. The system of claim 1, wherein the actuator comprises a hydraulic piston, wherein the hydraulic piston comprises the piston sleeve disposed about the mandrel and coupled to the plurality of grapples.

8. The system of claim 7, comprising a first pressure sensor configured to measure a first pressure on a first side of the hydraulic piston and a second pressure sensor configured to measure a second pressure on a second side of the hydraulic piston.

9. A method, comprising:
detecting a first parameter indicative of an axial or circumferential position of a plurality of grapples configured to engage with an inner diameter of a tubular;
calculating a radial travel distance of the plurality of grapples based on the first parameter indicative of the axial or circumferential position of the plurality of grapples using one or more processors of a calculation system; and
calculating an internal stress on the tubular based on the radial travel distance of the plurality of grapples using the one or more processors of the calculation system.

10. The method of claim 9, wherein detecting the first parameter indicative of the axial or circumferential position of the plurality of grapples configured to engage with the inner diameter of the tubular comprises detecting a magnetic field strength of a magnet coupled to the grapples with a magnetometer.

11. The method of claim 9, comprising detecting a second parameter indicative of contact between the plurality of grapples and the inner diameter of the tubular using a pressure sensor system of the top drive.

12. The method of claim 11, wherein detecting the second parameter indicative of contact between the plurality of grapples and the inner diameter of the tubular comprises detecting a pressure increase within a hydraulic piston configured to actuate the plurality of grapples.

13. The method of claim 9, comprising translating the plurality of grapples in an axial or circumferential direction with an actuator.

14. The method of claim 13, comprising translating the plurality of grapples along angled surfaces of a mandrel disposed between the plurality of grapples.

15. A system, comprising:
a data collection system; and
a calculation system,
wherein the data collection system comprises:
a magnet coupled to a plurality of grapples configured to engage with an inner diameter of a tubular;
a magnetometer coupled to an actuator housing of an actuator, wherein the actuator is configured to axially actuate the plurality of grapples, wherein the magnetometer is axially aligned with the magnet; and
a signal transmitter coupled to the actuator and configured to transmit a measurement detected by the magnetometer to the calculation system,
wherein the calculation system comprises:
one or more non-transitory, computer-readable media having executable instructions stored thereon, the executable instructions comprising:
instructions configured to calculate a radial travel distance of the plurality of grapples based on the measurement detected by the magnetometer; and instructions configured to calculate an internal stress on the tubular based on the radial travel distance of the plurality of grapples.

16. The system of claim 15, wherein the measurement comprises a magnetic field strength of the magnet.

17. The system of claim 15, wherein the calculation system comprises an alarm configured to activate when the internal stress meets or exceeds a threshold value.

* * * * *